US005424002A

United States Patent [19]

Omure et al.

[11] Patent Number: 5,424,002

[45] Date of Patent: Jun. 13, 1995

[54] SOLVENT COMPOSITION COMPRISING MIXTURE OF POLYFLUOROALKANE AND LOWER ALCOHOL

[75] Inventors: Yukio Omure; Hirokazu Aoyama; Satoshi Ide; Takahiro Matsuda, all of Settsu, Japan

[73] Assignee: Daikin Industries, Ltd., Osaka, Japan

[21] Appl. No.: 199,190

[22] PCT Filed: Aug. 26, 1992

[86] PCT No.: PCT/JP92/01072

§ 371 Date: Feb. 28, 1994

§ 102(e) Date: Feb. 28, 1994

[87] PCT Pub. No.: WO93/04160

PCT Pub. Date: Mar. 4, 1993

[30] Foreign Application Priority Data

Aug. 26, 1991 [JP] Japan ..... 3-213894
Aug. 26, 1991 [JP] Japan ..... 3-213895

[51] Int. Cl.[6] ..... C11D 7/30; C11D 7/50

[52] U.S. Cl. ..... 252/171; 134/40; 252/170; 252/194; 252/364; 252/DIG. 9

[58] Field of Search ..... 252/162, 170, 171, 172, 252/364, DIG. 9, 194; 134/40

[56] References Cited

U.S. PATENT DOCUMENTS 5,059,728 10/1991 Li et al. ..... 570/134
5,116,426 5/1992 Asano et al. ..... 134/40
5,219,488 6/1993 Basu et al. ..... 252/171
5,219,489 6/1993 Swan et al. ..... 252/171
5,221,361 6/1993 Anton et al. ..... 137/38
5,225,009 7/1993 Basu et al. ..... 252/171
5,298,083 3/1994 Van Der Puy et al. ..... 134/42
5,346,645 9/1994 Omure et al. ..... 252/364

FOREIGN PATENT DOCUMENTS 431458 6/1991 European Pat. Off. .
1-139540 6/1989 Japan .
1-304194 12/1989 Japan .
1-319595 12/1989 Japan .
93/09216 5/1993 WIPO .

OTHER PUBLICATIONS

Chemical Abstract No. 60:1572oh, Chambers et al., "Telemerization reactions in the synthesis of Models for Same Fluorocarbon Polymers", *Tetrahedron* 20(3) pp. 497–506 1964 Abstract published Jun. 1964.

Grant & Hackh's *Chemical Dictionary* Fifth Edition, McGraw-Hill Book Co. N.Y. *1987 pp. 402, 549, 556.

*Primary Examiner*—Linda Skaling
*Attorney, Agent, or Firm*—Larson & Taylor

[57] ABSTRACT

A solvent composition comprising a mixture of at least one polyfluoroalkane and at least one lower alcohol, wherein the polyfluoroalkane is selected among those represented by the general formula (1): $(CF_3)_2CF—R$ wherein R represents a fluorinated ethyl group substituted by 1 to 4 fluorine atoms, and the lower alcohol is selected from the group consisting of methyl, ethyl, n-propyl and isopropyl alcohol.

5 Claims, No Drawings

SOLVENT COMPOSITION COMPRISING MIXTURE OF POLYFLUOROALKANE AND LOWER ALCOHOL

TECHNICAL FIELD

The present invention relates to a solvent composition comprising a mixture of polyfluoroalkanes and lower alcohols.

In this specification and claims, "%" and "parts" mean "weight %" and "weight parts", respectively.

BACKGROUND ART

Trichlorofluoroethane (hereinafter referred to as CFC113), one of chlorofluoroethane compounds, has been widely used singly or in a form of a mixture or azeotropic composition with another organic solvent as a solvent, cleaning agent, etc., since CFC113 has excellent properties, such as (i) nonflammability, (ii) low toxicity in vivo, selectively solubilizing fats and oils, grease, wax and the like without attacking on plastics, rubber and like high polymers.

It has become an issue that CFC113 and like chlorofluorocarbon compounds substituting chlorine and fluorine atoms for all hydrogen atoms of hydrocarbons (hereinafter referred to as perhalocarbons) destruct the ozonesphere, as a result, cause an environmental pollution on a global scale. It is an urgent problem to reduce the usage of perhalocarbons progressively, and to totally abolish perhalocarbons soon.

However, a useful material which is capable of substitution of CFC113 used singly or in an azeotropic mixture with other organic solvent, and material which does not destruct an ozone layer has not been found yet.

Further, it is essential to provide a mixed solvent imparted a variety of functions by mixing another organic solvent according to applications and objects thereof. It is important that control of the mixed solvent, when used, should be easy, and that the mixed solvent can be recovered and reused. It is preferred that steam wash can be performed. However, finding such a composition is, in fact, very difficult, and such an azeotropic mixture has not been discovered.

DISCLOSURE OF THE INVENTION

The inventors of the present invention, who were engaged in intensive research in view of the prior art, discovered that a composition comprising polyfluorobutane having a trifluoromethyl group at 2-position and a lower alcohol substantially meet the requirement mentioned above. The present invention has been accomplished.

Thus, the invention provides a mixed solvent composition shown below:

"A mixed solvent composition comprising at least one selected from polyfluoroalkanes and at least one selected from lower alcohols, in which said polyfluoroalkanes are selected from the group consisting of compounds represented by the formula (1):

$$(CF_3)_2CF-R \qquad (1)$$

wherein R represents a fluoroethyl group having 1 to 4 fluorine atoms. and said lower alcohols are selected from the group consisting of methyl alcohol, ethyl alcohol, n-propyl alcohol and isopropyl alcohol."

A fluoroethyl group having 1 to 4 fluorine atoms represented by R includes:

(1) $C_2F_4H$: $CF_2CF_2H$ or $CFHCF_3$;
(2) $C_2F_3H_2$: $CF_2CFH_2$, $CFHCF_2H$ or $CH_2CF_3$;
(3) $C_2F_2H_3$: $CF_2CH_3$, $CFHCFH_2$ or $CH_2CF_2H$;
(4) $C_2FH_4$: $CFHCH_3$ or $CH_2CFH_2$.

Examples of preferred fluoroethyl groups represented by R are $CF_2CF_2H$ and $CH_2CF_2H$.

In the invention, at least one of compounds of formula (1) and at least one selected from the group consisting of methyl alcohol, ethyl alcohol, n-propyl alcohol and isopropyl alcohol are mixed in a specific proportion. Preferable compositions comprising a compound of formula (1) and a lower alcohol are as follows:

* a composition comprising 2-trifluoromethyl-1,1,1,2,3,3,4,4-octafluorobutane and methyl alcohol and/or ethyl alcohol; and
* a composition comprising 2-trifluoromethyl-1,1,1,2,4,4-hexafluorobutane and at least one selected from the group consisting of methyl alcohol, ethyl alcohol, n-propyl alcohol or isopropyl alcohol.

A preferred blending ratio of said composition is, in 100 parts of the composition, accomplished by blending 96.7–97.9 parts of 2-trifluoromethyl-1,1,1,2,3,3,4,4-octafluorobutane with 3.3–2.1 parts of methyl alcohol and/or ethyl alcohol, or by blending 93.3–95.8 parts of 2-trifluoromethyl-1,1,1,2,4,4-hexafluorobutane and 6.7.–4.2 parts of methyl alcohol and/or ethyl alcohol and/or isopropyl alcohol.

Specifically, the more preferred compositions of the invention are:

* an azeotropic composition (azeotropic point: 37.0° C.) comprising 96.7% of 2-trifluoromethyl-1,1,1,2,3,3,4,4-octafluorobutane and 3.3% of methyl alcohol;
* an azeotropic composition (azeotropic point: 41.0° C.) comprising 97.9% of 2-trifluoromethyl-1,1,1,2,3,3,4,4-octafluorobutane and 2.1% of ethyl alcohol;
* an azeotropic composition (azeotropic point: 43.0° C.) comprising 93.3% of 2-trifluoromethyl-1,1,1,2,4,4-hexafluorobutane and 6.7% of methyl alcohol;
* an azeotropic composition (azeotropic point: 47.0° C.) comprising 95.4% of 2-trifluoromethyl-1,1,1,2,4,4-hexafluorobutane and 4.6% of ethyl alcohol; and
* an azeotropic composition (azeotropic point: 49.3° C.) comprising 95.8% of 2-trifluoromethyl-1,1,1,2,4,4-hexafluorobutane and 4.2% of isopropyl alcohol.

In the invention, compounds represented by formula (1) can be produced according to the reaction procedure shown below.

<Reaction Procedure>

$$\underset{(2)}{(CF_3)_2CF-I} + \underset{(3)}{R^1R^2C=CR^3R^4} \longrightarrow$$

$$\underset{(4)}{(CF_3)_2CFR^1R^2C-CR^3R^4I} \xrightarrow{\text{Reduction}} \underset{(1)}{(CF_3)_2CF-R}$$

wherein R is the same as above, $R^1$, $R^2$, $R^3$ and $R^4$ are same or different, and represent a hydrogen atom or fluorine atom, provided that at least one of $R^1$, $R^2$, $R^3$ and $R^4$ is a fluorine atom.

An ethylene adduct (4) is prepared by reacting perfluoroisopropyliodide (2) with a fluorine atomcontaining ethylene compound (3), the compound is reduced with a reducing agent to give the desired compound of formula (1).

Said compound (4) is obtained by reacting 1 mole of perfluoroisopropyliodide (2) with 0.9–1.1 moles of ethylene compound (3) in a solvent, preferably in a presence of catalyst. Benzoylperoxide, azobisisobutyronitrile and like free radical initiators are exemplified as catalyst. The catalyst is used about 0.1–20 mole % per 1 mole of perfluoroisopropyliodide (2). A reaction solvent is not always necessary. When necessary, chloroform, dichloromethane and like halogenated hydrocarbons, benzene, toluene, and like aromatic hydrocarbons can be used. Reaction time is about 1–24 hours and reaction temperature is about 40°–120° C. The compound (4) thus obtained is then reduced in a solvent to give a target compound of formula (1). The reduction can be performed by using sodium boron hydride, lithium alminium hydride and like reducing agents. As a solvent, methyl alcohol, ethyl alcohol and like alcohols, tetrahydrofuran and like ethers are exemplified. About 1–2 moles of a reducing agent are used per 1 mole of compound (4). Reaction time is about 1–24 hours, and reaction temperature is about 0 to room temperature.

In each step, purification can be done by conventional purification means, such as silica gel column chromatography, solvent extraction and distillation.

The composition of the invention demonstrate higher stability than a mixture containing CFC113, when necessary, a stabilizer can be added to the composition. The stabilizer is preferably simultaneously distilled or forms an azeotropic mixture.

Specifically, the stabilizer includes nitromethane, nitroethane, nitropropane, nitrobenzene, nitrostylene and like nitro compounds; 3-methyl-1-butyn-3-ol, 3-methyl-1-pentyn-3-ol and like acetylene alcohols; glycidol, methylglycidylether, allylglycidylether, phenylglycidylether, 1,2-butyleneoxide, cyclohexeneoxide, epichlorohydrin and like epoxides; dimethoxymethane, 1,2-dimethoxyethane, 1,4-dioxane, 1,3,5-trioxane and like ethers; hexene, heptene, octene, 2,4,4-trimethyl-1-pentene, pentadiene, octadiene, cyclohexene, cyclopentene, and like unsaturated hydrocarbons; allylalcohol, 1-butene-3-ol, 3-methyl-1-butene-3-ol and like olefinic alcohols; methyl acrylate, ethyl acrylate, butyl acrylate, vinyl methacrylate and like acrylate esters. These ,can be used individually or a mixture of two or more. Nitromethane is preferable in them.

A synergically and more improved stabilization effect can be exerted by combination of the stabilizer mentioned above and another stabilizer shown below. The stabilizer includes phenol, trimethylphenol, thymol, 2,6-di-t-butyl-4-methylphenol, butylhydroxyanisole, isoeugenol and like phenols; dipropylamine, diisopropylamine, triethylamine, tributylamine, pyridine, N-ethylmorpholine, 2,2,6,6-tetramethylpiperidine, N,N'-diallyl-p-phenylenediamine and like amines; benzotriazole, 2-(2'-hydroxy-5'-methylphenyl)benzotriazole, chlorobenzotriazole and like triazoles.

The usage of the stabilizer is varied according to a sort thereof, and is determined so as not to interfere distillation of the composition. The usage is generally about 0.1–10% based on the weight of the composition of the invention, preferably about 0.5–5%. The usage of nitromethane is preferably about 0.1–1%.

Further, to the composition of the invention can be added a variety of surfactant, when necessary, in order to improve a detergent action, interfacial tension, etc. of the composition. As surfactants can be used one or more of nonionic surfactant such as, sorbitan monooleate, sorbitan trioleate and like sorbitan fatty acid esters; sorbitol tetraoleate of polyoxyethylene and like polyoxyethylene sorbitol fatty acid esters; polyoxyethylene monolaurate and like polyethyleneglycol fatty acid esters; polyoxyethylene lauryl ether, polyoxyethylene oleyl ether and like polyoxyethylene alkyl ethers; polyoxyethylene-polyoxypropylenecetylether and like polyoxyethylene-polyoxypropylenealkylethers; polyoxyethylenenonyl-phenylether and like polyoxyethylene alkylphenylethers; polyoxyethyleneoleylamine, polyoxyethylene oleic acid amide and like polyoxyethylene fatty acid amides. Cationic surfactants or anionic surfactants can be further combined. Cationic surfactant and anionic surfactant in themselves are difficult to be dissolved in the composition. However a solubility of them become higher, when combined with nonionic surfactants, to synergecally improve a detergent action and interfacial tension of the composition.

The usage of surfactants is, varied according to a sort of surfactants, about −0.1–20%, preferably 0.3–5% based on the weight of the composition of the invention.

According to the invention, the following effects are exerted:

There is no risk of destruction of the ozone layer, since perhalocarbons are not included in the composition.

The composition is very safe when used, since the composition is nonflammable or flame-retardant.

When the composition of the invention is azeotropic, composition is not changed in service so that control, recover and reuse of the composition are easy. The azeotropic composition can be used in steam wash which is essential for finish of washing and drying.

It is difficult to conduct hydroextraction when singly using trifluorobutane having trifluoromethyl group at 2-position. In contrast, the mixed solvent composition of the invention is very advantageous in hydroextraction. Specifically, the composition of the invention is useful in hydroextraction of a wafer, plating product, optical lens, mask for photolithography, liquid crystal display component which are used for production of semiconductors (IC, LSI, etc.), components of a variety of metals, plastics, glass, ceramics etc. and materials, after washing and rincing.

Further, the composition is preferable for washing of printed-wiring boards, removal of cutting oil used for metal work, dissolution of fluorine-containing oil.

The composition is chemically stable so that the composition can be used in washing and drying of metals, plastics, rubers etc. with little influence.

EXAMPLE

The invention is described in more detail using the examples. The present invention is in no way limited by the examples.

Example 1

A 200 g of a mixture consisting of 70 parts of 2-trifluoromethyl-1,1,1,2,3,3,4,4-octafluorobutane (b.p. 44.5° C.) and 30 parts of methyl alcohol (b.p. 64.8° C.) was added to a distillation flask, and distilled under normal pressure using fractionating column having theoretical plate number of 30. The mixture indicated azeotropy at an azeotropic point of 37.0° C. which is lower than boiling points of both components.

The fraction thus obtained was analyzed with gas chromatography to show that the fraction consisted of 96.7% of 2-trifluoromethyl-1,1,1,2,3,3,4,4-octafluorobutane and 3.3% of methyl alcohol.

Example 2

An azeotropic composition (azeotropic point: 41.0° C.) consisting of 97.9% of 2-trifluoromethyl-1,1,1,2,3,3,4,4,-octafluorobutane and 2.1% of ethyl alcohol was obtained in the same way as in Example 1 except that ethyl alcohol was used in place of methyl alcohol.

Example 3

A 200 g of a mixture consisting of 70 parts of 2-trifluoromethyl-1,1,1,2,4,4-hexafluorobutane (b.p. 51.5° C.) and 30 parts of methyl alcohol (b.p. 64.8° C.) was added to a distillation flask, and distilled under normal pressure using fractionating column having theoretical plate number of 30. The mixture indicated azeotropy at an azeotropic point of 43.0° C. which is lower than boiling points of both components.

The fraction thus obtained was analyzed with gas chromatography to show that the fraction consisted of 93.3% of 2-trifluoromethyl-1,1,1,2,4,4-hexafluorobutane and 6.7% of methyl alcohol.

Example 4

An azeotropic composition (azeotropic point: 47.0° C.) consisting of 95.4% of 2-trifluoromethyl-1,1,1,2,4,4-hexafluorobutane and 4.6% of ethyl alcohol was obtained in the same way as in Example 3 except that ethyl alcohol was used in place of methyl alcohol.

Example 5

An azeotropic composition (azeotropic point: 49.3° C.) consisting of 95.8% of 2-trifluoromethyl-1,1,1,2,4,4-hexafluorobutane and 4.2% of isopropyl alcohol was obtained in the same way as in Example 3 except that isopropyl alcohol was used in place of methyl alcohol.

Experimental Example 1

Five azeotropic compositions obtained in examples 1–5, 2-trifluoromethyl-1,1,1,2,3,3,4,4-octafluorobutane as reference example 1, and 2-trifluoromethyl-1,1,1,2,4,4-hexafluorobutane as reference example 2 were used for conducting the following tests. Drying characteristics of an article wetted with water (drying characteristics with hydro-extraction)

A surface-cleaned glass plate wetted with water (50 mm×50 mm×1 mm) was treated by methods A to D shown below to remove water:

A—dipping (in a composition at a temperature 5° C. lower than boiling point of the composition) for 1 minute→contacting steam for 1 minute;

B—dipping (in a boiling composition) for 1 minute→ contacting steam for 1 minute;

C—spraying (at a temperature 5° C. lower than boiling point of the composition) for 30 seconds contacting steam for 1 minute; and D—contacting steam for 1 minute.

The glass plate treated to remove water was then dipped in absolute methyl alcohol to measure an amount of increased water in methyl alcohol after dipping by Karl Fisher method. The amount of water remained on the glass plate was taken as "$W_1$".

The plate (50 mm×50 mm×1 mm) wetted with water was dipped in a predetermined amount of absolute methyl alcohol without conducting the treatment of the invention to measure the amount of increased water in methyl alcohol after dipping by Karl Fisher method. The amount of water was taken as "W".

Dehydration rate H (%) was calculated according to the following equation:

$$H(\%)=(w-w_1)/W\times 100$$

The results are shown in Table 1.

Degreasing Power

The compositions of the invention were added to a three-bath desk type washing machine equipped with ultrasonic bath—ultrasonic bath—steam bath, and a degreasing wash test was conducted by washing a steel plate (30 mm×60 mm×2 mm) on which a thin layer of oil for metal processing was formed. As washing, an ultrasonic washing was conducted in a heated bath for one minute at a temperature 5° C. lower than an azeotropic point of the composition of the invention or than boiling point of compounds of comparative examples 1 and 2, and then steam washing was conducted for one minute. Subsequently, an amount of oil remaining on the steel plate was determined with an oil content meter (product of HORIBA). The results are shown in table 1 as degree of degrease.

Effect on Plastics

Plastic test pieces (50 mm×50 mm×2 mm) shown in table 2 were dipped in each of 7 solvents from examples 1–5 and comparative examples 1–2 for 1 hour in a thermostat at a preset temperature of 50° C. Changes of weight and volume of the pieces were checked immediately after taking out the pieces from the solvents. The results were evaluated using the criteria below.

1: increase of weight or volume within 0 to 2% or less;

2: increase of weight or volume within 2 to 5% or less;

3: increase of weight or volume more than 5%;

4: dissolved.

The results are shown in table 2.

Chemical Stability

A 50 g of the azeotropic compositions obtained from examples 1–5 or comparative examples 1–2, water corresponding to 0.1% and a metal (Al or Zn) were put into a 50-ml volume of glass bottle with a stopper, stoppering the bottle and the bottle was then heated at 50° C. in a thermostat for 30 days to conduct a gross investigation whether corrosions were formed on the metal after heating.

The results are shown in table 2.

TABLE 1

| Azeotropic Composition | degree of water removal (%) A | B | C | D | degree of degrease (%) |
|---|---|---|---|---|---|
| Example 1 | 96 | 97 | 97 | 91 | 99.8 |
| Example 2 | 94 | 96 | 96 | 90 | 99.6 |
| Comparative Example 1 | <10 | <10 | <10 | <10 | 99.1 |
| Example 3 | 98 | 99 | 99 | 93 | 99.8 |
| Example 4 | 97 | 98 | 99 | 92 | 99.6 |
| Example 5 | 95 | 97 | 98 | 90 | 99.5 |

TABLE 1-continued

| Azeotropic Composition | degree of water removal (%) A | B | C | D | degree of degrease (%) |
|---|---|---|---|---|---|
| Comparative Example 2 | <10 | <10 | <10 | <10 | 99.1 |

TABLE 2

| Azeotropic Composition | Influence to plastics ABS | Poly-carbonate | Poly-stylene | Chemical Stability Al | Zn |
|---|---|---|---|---|---|
| Example 1 | 1 | 1 | 1 | no corrosion | no corrosion |
| Example 2 | 1 | 1 | 1 | no corrosion | no corrosion |
| Comparative Example 1 | 1 | 1 | 1 | no corrosion | no corrosion |
| Example 3 | 1 | 1 | 2 | no corrosion | no corrosion |
| Example 4 | 1 | 1 | 1 | no corrosion | no corrosion |
| Example 5 | 1 | 1 | 1 | no corrosion | no corrosion |
| Comparative Example 2 | 1 | 1 | 1 | no corrosion | no corrosion |

As apparent from results shown in table 1 and table 2, the azeotropic compositions of the invention have outstanding properties as a cleaning agent.

We claim:

1. An azeotropic composition consisting essentially of about 96.7% by weight of 2-trifluoromethyl-1,1,1,2,3,3,4,4-octafluorobutane and about 3.3% by weight of methyl alcohol, and an azeotropic point thereof is 37.0° C. at normal pressure.

2. An azeotropic composition consisting essentially of about 97.9% by weight of 2-trifluoromethyl-1,1,1,2,3,3,4,4-octafluorobutane and about 2.1% by weight of ethyl alcohol, and an azeotropic point thereof is 41.0° C. at normal pressure.

3. An azeotropic composition consisting essentially of about 93.3% by weight of 2-trifluoromethyl-1,1,1,2,4,4-hexafluorobutane and about 6.7% by weight of methyl alcohol, and an azeotropic point thereof is 43.0° C. at normal pressure.

4. An azeotropic composition consisting essentially of about 95.4% by weight of 2-trifluoromethyl-1,1,1,2,4,4-hexafluorobutane and about 4.6% by weight of ethyl alcohol, and an azeotropic point thereof is 47.0° C. at normal pressure.

5. An azeotropic composition consisting essentially of about 95.8% by weight of 2-trifluoromethyl-1,1,1,2,4,4-hexafluorobutane and about 4.2% by weight of isopropyl alcohol, and an azeotropic point thereof is 49.3° C. at normal pressure.

* * * * *